US011052456B1

(12) United States Patent
Kamiyama et al.

(10) Patent No.: US 11,052,456 B1
(45) Date of Patent: Jul. 6, 2021

(54) CASTING MOLD AND MANUFACTURING METHOD OF CAST PART

(71) Applicant: Marelli Corporation, Saitama (JP)

(72) Inventors: Naohisa Kamiyama, Saitama (JP); Toshihiko Kubo, Saitama (JP); Tetsuzo Nishimura, Ueda (JP); Makoto Murakami, Ueda (JP); Ikuo Kataoka, Ueda (JP); Shinya Sato, Ueda (JP); Takaaki Ikari, Tokyo (JP)

(73) Assignee: Marelli Cabin Comfort Japan Corporation, Saitama (JP)

( * ) Notice: Subject to any disclaimer, the term of this patent is extended or adjusted under 35 U.S.C. 154(b) by 0 days.

(21) Appl. No.: 16/634,478

(22) PCT Filed: Jul. 25, 2018

(86) PCT No.: PCT/JP2018/027980
§ 371 (c)(1),
(2) Date: Jan. 27, 2020

(87) PCT Pub. No.: WO2019/022167
PCT Pub. Date: Jan. 31, 2019

(30) Foreign Application Priority Data

Jul. 28, 2017 (JP) ..... JP2017-146981

(51) Int. Cl.

| | |
|---|---|
| ***B22D 19/00*** | (2006.01) |
| ***B22D 17/22*** | (2006.01) |
| ***B22C 9/08*** | (2006.01) |
| ***B22C 19/00*** | (2006.01) |

(52) U.S. Cl.
CPC ..... *B22C 9/08* (2013.01); *B22C 19/00* (2013.01); *B22D 17/22* (2013.01); *B22D 19/00* (2013.01)

(58) Field of Classification Search
CPC ..... B22C 9/06; B22C 9/08; B22D 17/22
See application file for complete search history.

(56) References Cited

U.S. PATENT DOCUMENTS

| | | | | |
|---|---|---|---|---|
| 2,190,828 | A * | 2/1940 | Deitz, Jr. | B22D 19/0072 164/121 |
| 4,693,293 | A * | 9/1987 | Yamamoto | B22D 19/16 164/100 |
| 2005/0259507 | A1* | 11/2005 | Ronkin | B29C 48/834 366/69 |
| 2018/0252432 | A1 | 9/2018 | Ogasawara et al. | |

FOREIGN PATENT DOCUMENTS

| | | | |
|---|---|---|---|
| CN | 101693293 | A | 4/2010 |
| CN | 205309261 | U | 6/2016 |
| JP | S47-30053 | U | 12/1972 |
| JP | S58-125362 | A | 7/1983 |
| JP | S63-281759 | A | 11/1988 |
| JP | H02-48266 | U | 4/1990 |
| JP | H03-142057 | A | 6/1991 |
| JP | H11-13532 | A | 1/1999 |
| JP | H11-198215 | A | 7/1999 |
| JP | 2017-53615 | A | 3/2017 |

* cited by examiner

*Primary Examiner* — Kevin E Yoon
(74) *Attorney, Agent, or Firm* — Young Basile Hanlon & MacFarlane, P.C.

(57) ABSTRACT

The casting mold is provided with: the molding wall portion forming the internal space; and the filling ports that open to the molding wall portion and that allow the molten metal to flow into the internal space. In this configuration the channel center lines of the filling ports intersect the surface of the heater at the non-perpendicular contact angle.

7 Claims, 5 Drawing Sheets

CASTING MOLD AND MANUFACTURING METHOD OF CAST PART

The present application claims priority to Japanese Patent Application No. 2017-146981 filed on Jul. 28, 2017, the entire disclosure of which is incorporated herein by reference.

TECHNICAL FIELD

The present invention relates to a casting mold for molding a cast part and a manufacturing method of the cast part.

BACKGROUND

JP47-30053U discloses a heat exchanger in which a spiral pipe, through which fluid flows, and a heat generating sheathed heater are cast into a cast part.

In the manufacture of this type of heat exchanger, structures such as the pipe and the sheathed heater are installed in a casting mold, before a molten metal is filled into the casting mold. The molten metal thus filled is solidified to form the cast part. The cast part taken out from the casting mold includes built-in pipe and sheathed heater.

SUMMARY

However, when the above-mentioned cast part is formed by, for example, a die casting method, there is a risk in that, as the molten metal injected into the casting mold at high speed hits the structure, the structure such as the pipe, etc. may be deformed.

An object of the present invention is to prevent deformation of a structure cast into a cast part.

According to an aspect of the present invention, there is provided a casting mold for molding a cast part by filling molten metal into an internal space in which a structure is installed, the casting mold comprising: a molding wall portion forming the internal space; and a filling port opens at the molding wall portion, the filling port allows the molten metal to flow into the internal space, wherein a center line of the filling port intersect a surface of the structure at a non-perpendicular contact angle.

In addition, according to an aspect of the present invention, there is provided a manufacturing method of a cast part for molding the cast part by filling molten metal into an internal space of a casting mold in which a structure is installed, wherein the casting mold is provided with a molding wall portion forming the internal space; and a filling port opens at the molding wall portion, the filling port allows the molten metal to flow into the internal space, a center line of the filling port intersects a surface of the structure at a non-perpendicular contact angle, and the manufacturing method including: a filling step for filling the molten metal into the internal space through the filling port.

According to the above-described aspect, the molten metal flow flowing into the internal space from the filling port flows along the surface of the structure, and the molten metal flow is suppressed from hitting from the direction perpendicular to the surface of the structure. With such a configuration, the load imparted to the structure by the molten metal flow is suppressed to the minimum, and therefore, it is possible to prevent deformation of the structure.

DETAILED DESCRIPTION

Figure 1:
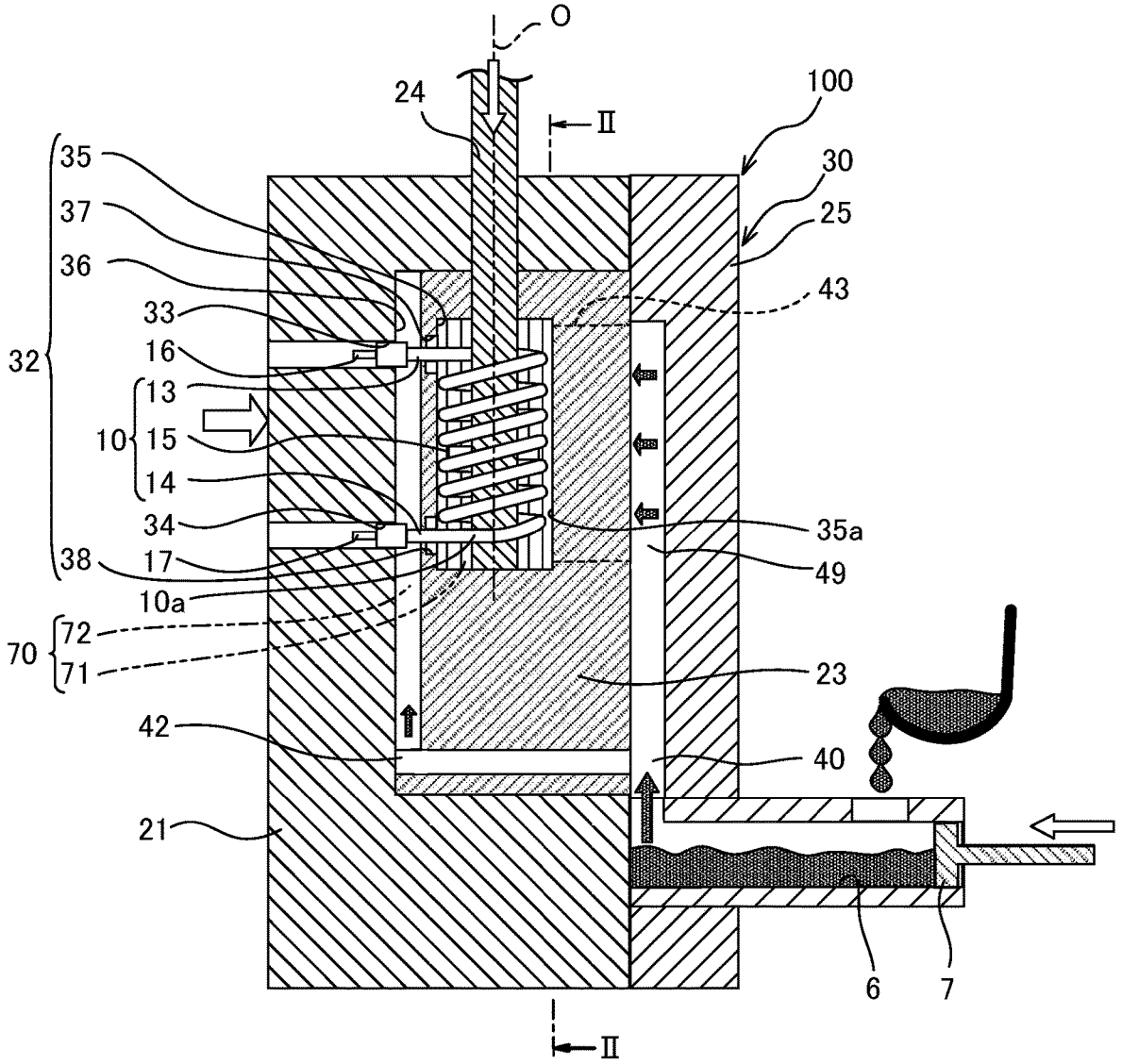
FIG. 1 is a vertical cross-sectional view showing a casting mold according to an embodiment of the present invention.

Embodiments of the present invention will be described below with reference to the attached drawings.

FIGS. 1 to 4 are cross-sectional views showing a casting device 100 to which a casting mold 30 according to the present embodiment is applied. For simplification of the description, a part of the casting device 100 is omitted in the drawing.

The casting device 100 for the die casting method is provided with a pressurizing part (piston) 7 for pressurizing a molten metal injected into an injection chamber 6 and the casting mold 30 forming an internal space 90 that is filled with the molten metal discharged from the injection chamber 6 by the pressurizing part 7. The molten metal is obtained by melting a metal such as an aluminum alloy, for example. As will be described later, in the casting mold 30, a cast part 70 is molded as the molten metal filled in the internal space 90 is solidified.

The casting mold 30 is provided with a fixed mold 25, and a movable mold 21, lateral slides 22 and 23, and a core 24 that are removed after molding. In the casting mold 30, the internal space 90 is formed as the movable mold 21, the lateral slides 22 and 23, and the core 24 are moved in the direction indicated by an outline arrow with respect to the fixed mold 25 and are held at predetermined positions.

In the internal space 90 of the casting mold 30, a heater 10 is installed as a structure to be cast into the cast part 70.

The heater 10 is a sheathed heater provided with a heat generating portion (not shown), which generates heat by energization, and a metal pipe (pipe) 10*a* for accommodating the heat generating portion. The heater 10 is not limited thereto, and may also be, for example, a PTC (Positive Temperature Coefficient) heater.

The heater 10 has end portions 13 and 14 serving as fixed portions supported by the casting mold 30 and a spiral extending portion 15 that extends from the end portions 13 and 14. Terminals 16 and 17 to which electrical wirings are connected are respectively provided at the distal ends of the end portions 13 and 14.

Figure 2:
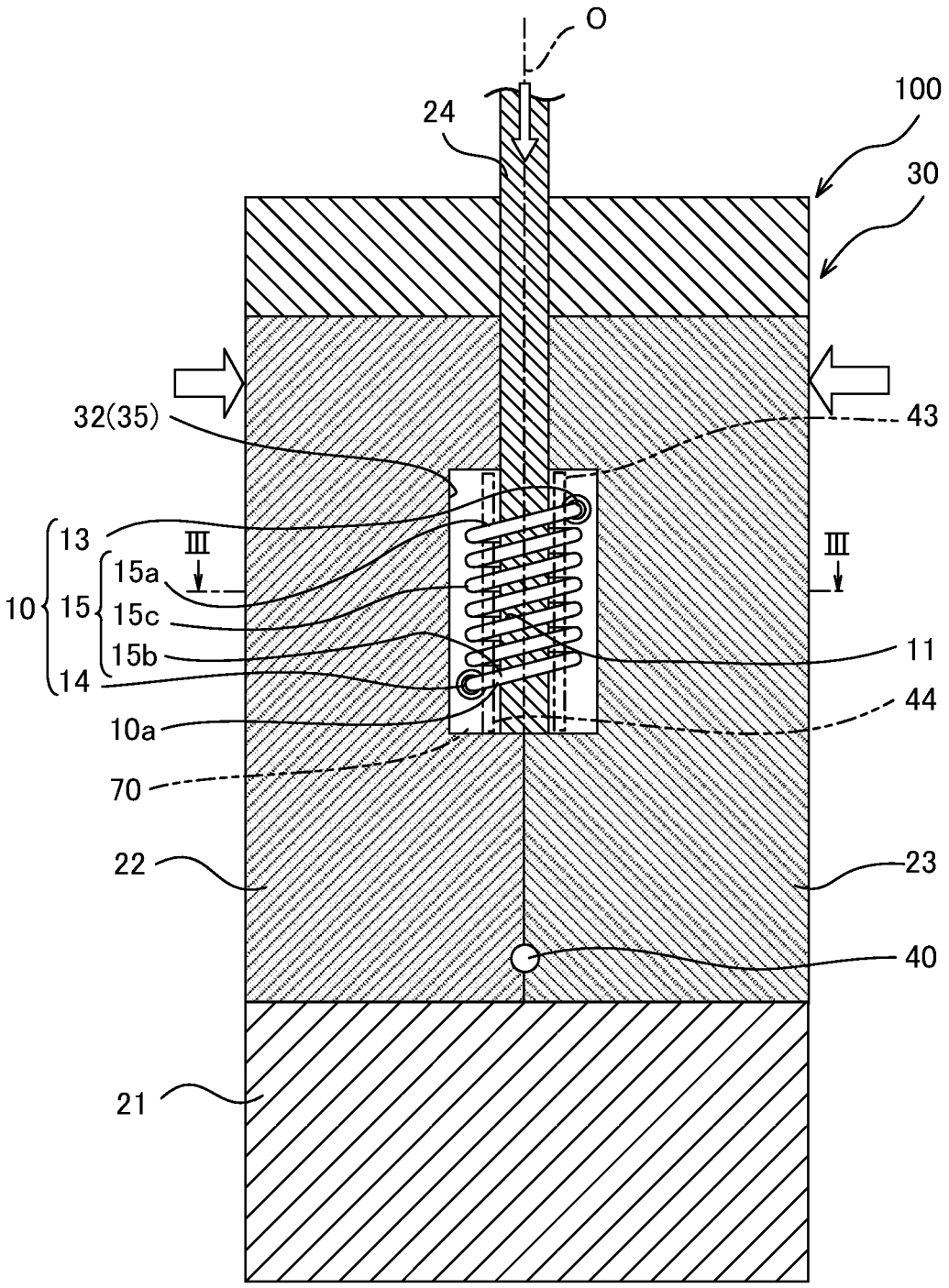
FIG. 2 is a longitudinal cross-sectional view taken along a line II-II in FIG. 1.
Figure 3:
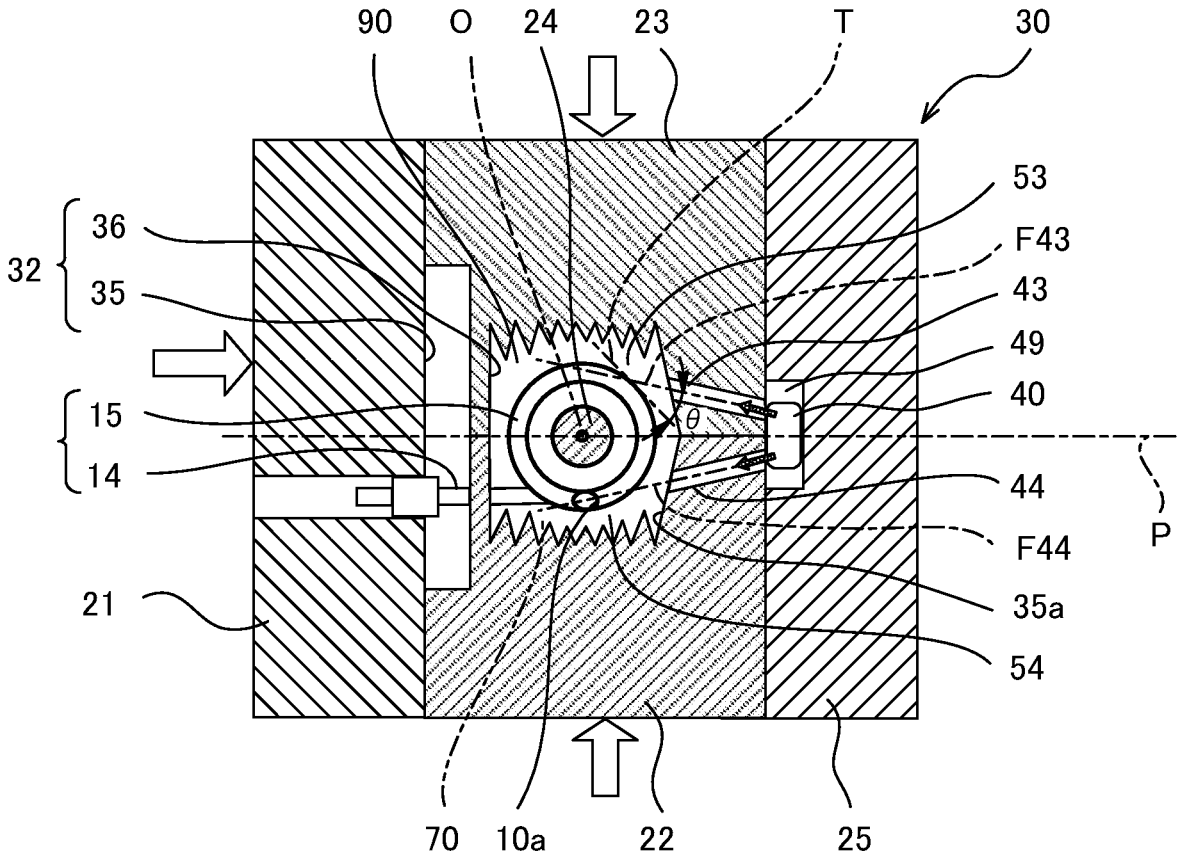
FIG. 3 is a lateral cross-sectional view taken along a line III-III in FIG. 2.

In the extending portion 15, the metal pipe 10*a* is spirally wound about the center line O. As shown in FIGS. 1 and 2, the metal pipe 10*a* is wound in the center line O direction. As shown in FIG. 3, the metal pipe 10*a* is wound in a substantially circular ring shape when viewed from the center line O direction.

The two end portions 13 and 14 extend substantially in parallel with each other from both ends of the extending portion 15. As shown in FIG. 1, the end portions 13 and 14 are formed so as to be substantially perpendicular with respect to the center line O. As shown in FIG. 2, the end portions 13 and 14 are respectively located in the vicinities of two opposing corner portions in the internal space 90.

The cast part 70 has a cylindrical shaped cylinder portion 71, into which the extending portion 15 is cast, and a plate-like lid portion 72, into which the end portions 13 and 14 are cast. The cylinder portion 71 and the lid portion 72 are integrally formed. The cylinder portion 71 has a plurality of fins that protrude out from its outer surface. It should be noted that the cast part 70 may have a single block shape into which the extending portion 15 and the end portions 13 and 14 are cast, without having the lid portion 72.

The casting mold 30 has a molding wall portion 32 for molding the cast part 70 and hole-shaped supporting portions 33 and 34 for supporting the end portions 13 and 14 of the heater 10.

The molding wall portion 32 has a wall portion 35 for molding the cylinder portion 71, a wall portion 36 for molding the lid portion 72, and hole-shaped wall portions 37 and 38 for molding portions connecting the cylinder portion 71 and the lid portion 72.

The casting mold 30 has filling ports 42 to 44 that open to the internal space 90 and a runner 40 through which the injection chamber 6 is communicated with the internal space 90 through the filling ports 42 to 44.

The lower filling port 42 facing a lower portion of the internal space 90 opens to a lower end surface of the wall portion 36. The lid portion 72 of the cast part 70 is formed by the molten metal that is filled into the internal space 90 in the wall portion 36 from the lower filling port 42.

The filling ports 43 and 44 facing a side portion of the internal space 90 open to a side end surface 35*a* of the wall portion 35. The cylinder portion 71 of the cast part 70 is formed by the molten metal filled into the internal space 90 in the wall portion 35 from the filling ports 43 and 44.

Next, a process of casting the cast part 70 by the casting device 100 will be described.

First, an installation process of installing the heater 10 in the internal space 90 of the casting mold 30 is performed. In this installation process, the heater 10 is first assembled to the movable mold 21. At this time, the end portions 13 and 14 of the heater 10 are inserted into the hole-shaped supporting portions 33 and 34 through the hole-shaped wall portions 37 and 38, and thereby, the heater 10 is installed at a predetermined position in the internal space 90. Subsequently, the movable mold 21, the lateral slides 22 and 23, and the core 24 are set to the fixed mold 25, so as the internal space 90 to be formed.

Next, a filling step of filling the internal space 90 with the molten metal is performed. In this filling step, the internal space 90 is first filled with an active gas (oxygen). Next, the high-temperature molten metal is injected into the injection chamber 6, and the pressurizing part 7 is driven to pressurize the molten metal. As a result, the molten metal pushed out from the injection chamber 6 flows into the internal space 90 from the filling ports 42 to 44 through the runners 40, as indicated by arrows in FIG. 1. At this time, the molten metal is injected into the internal space 90 as a high-speed spray from the filling ports 42 to 44. As a result, in the internal space 90, a vacuum state is formed as the active gas is combined with the molten metal, and thereby, the molten metal is filled completely without forming a hollow space. Thus, formation of a cavity in the cast part 70 is prevented. It should be noted that the present invention is not limited to this, and for example, a gas vent hole may be formed in the casting mold 30 such that the air in the internal space 90 is discharged to the outside as the internal space 90 is filled with the molten metal.

Thereafter, in the casting mold 30, the molten metal filled in the internal space 90 is solidified to form the cast part 70. The movable mold 21, the lateral slides 22 and 23, and the core 24 are then separated from the cast part 70, so as the cast part 70 removed from the fixed mold 25.

As described above, the cast part 70 is manufactured. The cast part 70 with the built-in heater 10 is assembled to a tank (not shown) as a heater unit. In the heater unit, the heat generated by the heater 10 is transferred to a fluid (medium) circulating in the tank via the cast part 70 so as to heat the fluid.

Next, the arrangement of the heater 10 and the filling ports 43 and 44 with respect to the internal space 90 in the casting mold 30 will be described.

The wall portion 35 and the filling ports 43 and 44 of the casting mold 30 form a weir that guides the molten metal, which has been injected into the internal space 90, to predetermined positions.

As shown in FIG. 2, the filling ports 43 and 44 have a substantially rectangular channel cross-sectional shape. The filling ports 43 and 44 are formed to have a slit shape in which the opening width in the center line O direction of the heater 10 is larger than the opening width in the direction perpendicular to the center line O.

The configuration of the casting mold 30 is not limited to that in which the slit shaped filling ports 43 and 44 extend in parallel with the center line O, and the casting mold 30 may have a configuration in which a plurality of filling ports are aligned in the direction of the center line O.

In FIG. 3, channel center lines F43 and F44 of a pair of filling ports 43 and 44 are inclined symmetrically with respect to the center line P perpendicular to the center line O of the heater 10 such that the center line O is located between the channel center lines F43 and F44. The filling ports 43 and 44 are formed such that the respective channel center lines F43 and F44 intersect the heater 10 by avoiding the central part of the heater 10 (the portion including the center line P). In other words, the filling ports 43 and 44 are formed such that the respective channel center lines F43 and F44 intersect a tangent line T in contact with a curved surface of the heater 10 at a non-perpendicular contact angle θ. It should be noted that the contact angle θ refers to the angle formed with the tangent line T at the position where each of the channel center lines F43 and F44 of the filling ports 43 and 44 intersects the tangent line T in contact with the surface of the heater 10. In other words, the filling ports 43 and 44 are formed such that the respective channel center lines F43 and F44 intersect the tangent line T in contact with the curved surface of the heater 10 so as not to be perpendicular.

As shown in FIG. 3, the pair of filling ports 43 and 44 extend in the directions in which they are gradually separated away from each other from a chamber 49 of the runner 40 towards the internal space 90. The filling ports 43 and 44 extend along the outer circumference of the spiral heater 10.

The filling ports 43 and 44 are arranged so as to respectively face gaps 53 and 54 around the heater 10. The gaps 53 and 54 are spaces formed between the outer circumference of the heater 10 and the molding wall portion 32.

With such a configuration, the molten metal injected from the filling ports 43 and 44 flows into the internal space 90 through the gaps 53 and 54 along the curved surface of the heater 10.

As described above, according to the present embodiment, there is provided the casting mold 30 provided with the filling ports 43 and 44 through which the molten metal is filled into the internal space 90 in which the heater 10 is installed.

When the molten metal is filled as described above, the molten metal in the form of a spray flows into the internal space 90 from the filling ports 43 and 44 at a speed of, for example, about 50 m/s. If the high-speed molten metal flow injected from the filling ports 43 and 44 hits the heater 10 from the direction perpendicular to the tangent line T in contact with the surface of the heater 10, the load imparted to the heater 10 is increased, and therefore, there is a risk in that the heater 10 may be deformed.

As a countermeasure against such a problem, according to the present embodiment, for the heater 10 (the structure), the casting mold 30 is provided with the molding wall portion 32 forming the internal space 90 and the filling ports 43 and 44 that open at the molding wall portion 32 and allow the molten metal to flow into the internal space 90. In this configuration, the channel center lines F43 and F44 of the filling ports 43 and 44 intersect the surface of the heater 10 at the non-perpendicular contact angle θ.

By being configured as described above, the molten metal injected from the filling ports 43 and 44 is suppressed from hitting the heater 10 from the direction perpendicular to the surface of the heater 10 and flows into the internal space 90 along the surface of the heater 10. With such a configuration, because the load imparted to the heater 10 by the molten metal flow is suppressed to the minimum, it is possible to prevent the deformation of the heater 10. Because the molten metal flow smoothly flows into the internal space 90 along the surface of the heater 10, the molten metal is completely filled into the respective portions in the internal space 90 without forming a hollow space. With such a configuration, with the cast part 70, the formation of the internal cavities is prevented and improvement in the quality is made possible.

In addition, according to the present embodiment, the configuration in which the pair of filling ports 43 and 44 extend in the directions in which they are gradually separated away from each other towards the internal space 90 from the chamber 49 of the runner 40 guiding the molten metal is employed.

By being configured as described above, the gap between the opening portions of the filling ports 43 and 44 to the chamber 49 is smaller than the gap between the opening portions of the filling ports 43 and 44 to the internal space 90, and so, it is possible to reduce the volume of the chamber 49. With such a configuration, it is possible to reduce an amount of waste material after the molten metal is solidified in the chamber 49.

It should be noted that the configuration of the casting mold 30 is not limited to that in which two filling ports 43 and 44 are provided, and the casting mold 30 may have a configuration in which single filling port is provided.

In addition, according to the present embodiment, the heater 10 forms the gaps 53 and 54 in the internal space 90. In this configuration, the filling ports 43 and 44 face the internal space 90 so as to respectively face the gaps 53 and 54.

By being configured as described above, the molten metal injected from the internal space 90 from the filling ports 43 and 44 towards the gaps 53 and 54 flows into the respective portions in the internal space 90 through the gaps 53 and 54. With such a configuration, the high-speed molten metal flow is suppressed from hitting the heater 10, and so, the deformation of the heater 10 due to the load applied by the molten metal flow is prevented. Because the molten metal flow smoothly flows into the internal space 90 through the gaps 11, the molten metal is completely filled into the respective portions in the internal space 90 without forming a hollow space. With such a configuration, with the cast part 70, the formation of the internal cavities is prevented and improvement in the quality is made possible.

In addition, according to the present embodiment, the casting mold 30 is provided with the plurality of supporting portions 33 and 34. The heater 10 is configured to have the extending portion 15 that is provided so as to extend between the plurality of end portions 13 and 14.

By being configured as described above, the extending portion 15 of the heater 10 is supported by the plurality of end portions 13 and 14 at the both ends, and so, bending stress caused by the molten metal flow is suppressed to the minimum. With such a configuration, it is possible to effectively prevent the deformation of the heater 10.

Thus, according to the present embodiment, it is possible to provide the manufacturing method of the cast part 70 for manufacturing the cast part 70 into which the heater 10 is cast using the casting mold 30.

In addition, according to the present embodiment, it is possible to provide the manufacturing method of the cast part 70 for manufacturing the cast part 70 into which the spiral metal pipe 10*a* is cast as the structure installed in the internal space 90.

With such a configuration, in the heater unit, the shape of the spiral metal pipe 10*a* prone to be deformed is maintained, and the desired performance can be obtained.

Next, a modification of the casting mold 30 shown in FIG. 4 will be described.

Figure 4:
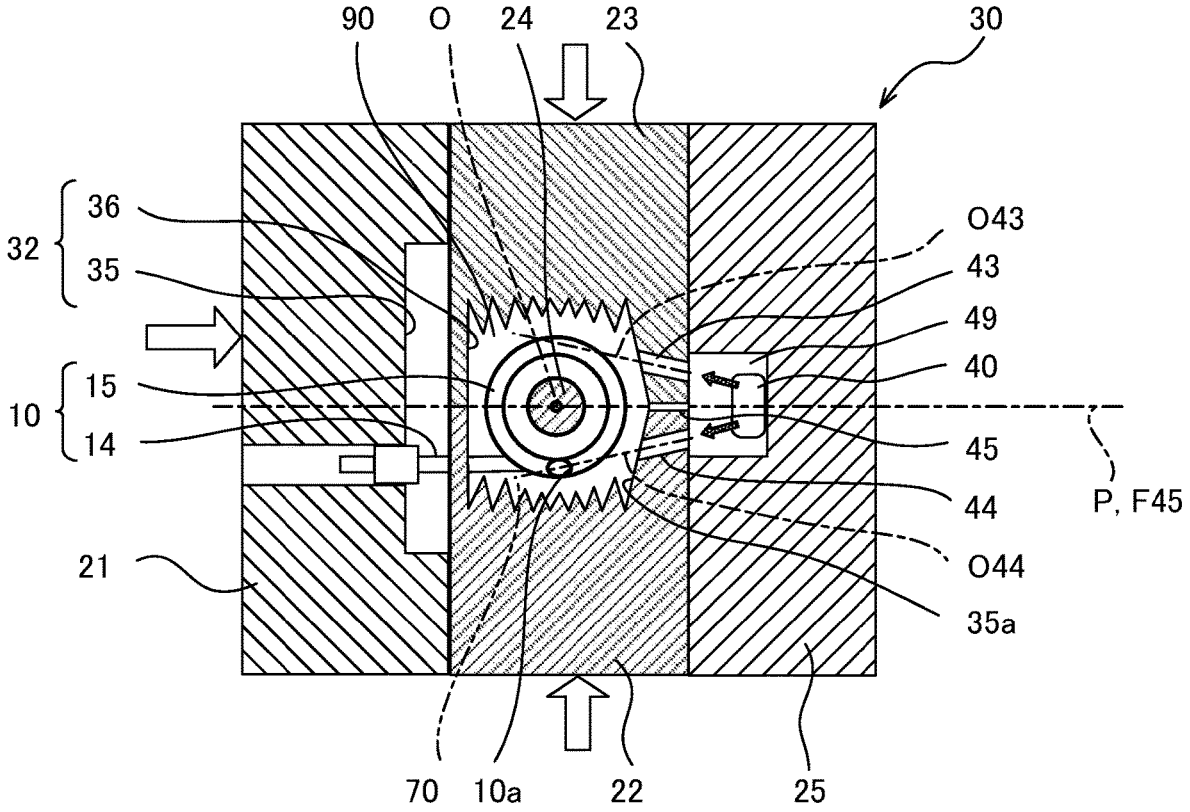
FIG. 4 is a lateral cross-sectional view showing a modification of the casting mold.

The casting mold 30 has a small filling port 45 having the opening width smaller than those of the filling ports 43 and 44 in the direction perpendicular to the center line O (in the up-down direction in FIG. 4).

The small filling port 45 is formed to have the slit shape that opens at a position aligned with the filling ports 43 and 44 in a line along the center line O.

A channel center line F45 of the small filling port 45 extends on the center line P and intersects the tangent line T for the surface of the heater 10 at the substantially perpendicular angle. In other words, the small filling port 45 is configured such that the channel center line F45 intersects the surface of the heater 10 at the substantially perpendicular contact angle.

By being configured as described above, in the filling step, the molten metal flow injected from the small filling port 45 hits the central part of the heater 10. The molten metal flow is decelerated as the molten metal flow passes through the small filling port 45 and resistance is imparted thereto, and therefore, even if the molten metal flow injected from the small filling port 45 hits the central part of the heater 10, the load imparted to the heater 10 by the molten metal flow is suppressed to the minimum. With such a configuration, it is possible to prevent the deformation of the heater 10.

Next, a modification of the casting mold 30 shown in FIG. 5 will be described.

Figure 5:
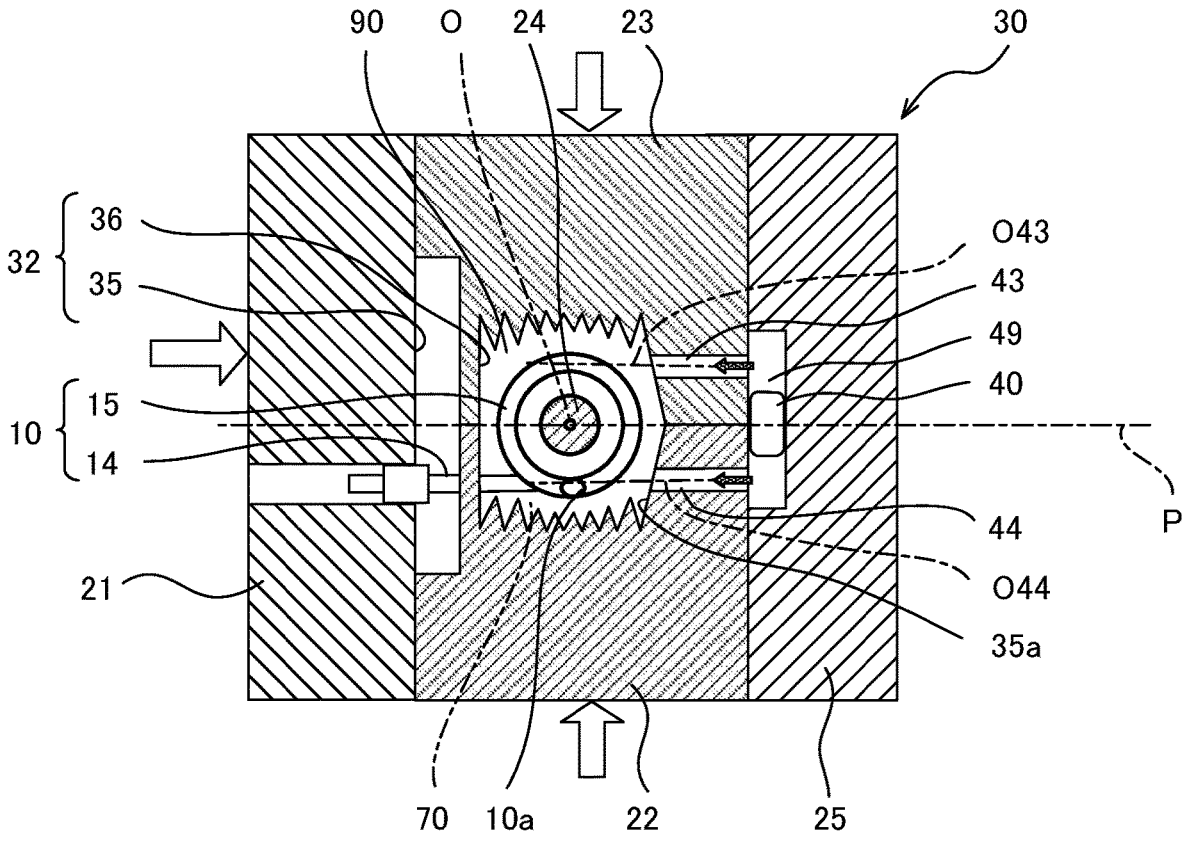
FIG. 5 is a lateral cross-sectional view showing another modification of the casting mold.

As shown in FIG. 5, the pair of filling ports 43 and 44 are formed such that the respective channel center lines F43 and F44 extend substantially in parallel with the center line P of the heater 10 perpendicular to the center line O such that the center line O of the heater 10 is located between the channel center lines F43 and F44.

The filling ports 43 and 44 are formed such that the respective channel center lines F43 and F44 intersect the tangent line T for the surface of the heater 10 at the angle which is not perpendicular. In other words, the filling ports 43 and 44 are configured such that the respective channel center lines F43 and F44 intersect the surface of the heater 10 at the non-perpendicular contact angle.

Also in this case, the molten metal injected from the filling ports 43 and 44 flows into the internal space 90 along the surface of the heater 10. With such a configuration, because the load imparted to the heater 10 by the molten metal flow is suppressed to the minimum, the deformation of the heater 10 due to the molten metal flow is prevented.

Embodiments of the present invention were described above, the above embodiments are merely examples of applications of this invention, and the technical scope of this invention is not limited to the specific constitutions of the above embodiments.

Although the present invention is suitable as the casting mold for casting the heater, it may also be applicable to the casting mold for casting the structure other than the heater.

Although the present invention is suitable as the casting method by the die casting method in which the molten metal is pressurized and filled into the casting mold, it may also be applicable to other casting methods.

The invention claimed is:

1. A casting mold for molding a cast part by filling molten metal into an internal space in which a structure is installed, the casting mold comprising:

a molding wall portion configured to form the internal space; and a filling port configured to open at the molding wall portion, the filling port being configured to allow the molten metal to flow into the internal space, wherein the structure is a metal pipe having a spiral portion, and a center line of the filling port intersects a curved surface of the spiral portion of the structure in a tangent line direction.

2. The casting mold according to claim 1, wherein a pair of the filling ports configured to extend in directions in which the pair of filling ports are gradually separated away from each other towards the internal space from a runner for guiding the molten metal.

3. The casting mold according to claim 1, wherein the molding wall portion is provided with a fin molding portion for molding a fin in the cast part.

4. The casting mold according to claim 1, further comprising a small filling port having an opening width smaller than the filling port, the small filling port being configured such that a center line thereof intersect the surface of the structure at a substantially perpendicular contact angle.

5. The casting mold according to claim 4, wherein the small filling port faces the internal space so as to face a gap formed in the structure.

6. A manufacturing method of a cast part for molding the cast part by filling molten metal into an internal space of a casting mold in which a structure is installed, wherein the casting mold is provided with a molding wall portion configured to form the internal space; and a filling port configured to open at the molding wall portion, the filling port being configured to allow the molten metal to flow into the internal space, the structure is a metal pipe having a spiral portion, a center line of the filling port intersect a curved surface of the spiral portion of the structure in a tangent line direction, and the manufacturing method comprising a filling step for filling the molten metal into the internal space through the filling port.

7. The manufacturing method of the cast part according to claim 6, wherein a spiral metal pipe is cast as the structure.

* * * * *